US005125339A

United States Patent [19]

Rogge

[11] Patent Number: 5,125,339

[45] Date of Patent: Jun. 30, 1992

[54] APPARATUS FOR DISPLACING SHAFT-MOUNTING BEARING STANDS

[75] Inventor: Dieter Rogge, Lengerich, Fed. Rep. of Germany

[73] Assignee: Windmoller & Holscher, Lengerich, Fed. Rep. of Germany

[21] Appl. No.: 643,986

[22] Filed: Jan. 22, 1991

[30] Foreign Application Priority Data

Jan. 22, 1990 [DE] Fed. Rep. of Germany ..... 4001735

[51] Int. Cl.[5] ..... B41F 13/24

[52] U.S. Cl. ..... 101/247; 101/182; 101/185; 101/209; 101/351; 101/352; 101/218; 101/140; 101/144; 101/145

[58] Field of Search ..... 101/247, 182, 184, 185, 101/209, 351, 352, 218, 152, 153, 139, 140, 144, 145, 285

[56] References Cited

U.S. PATENT DOCUMENTS

| | | | |
|---|---|---|---|
| 1,451,726 | 4/1923 | Zuckerman | 101/247 |
| 2,102,386 | 12/1937 | Scott et al. | 101/152 |
| 2,539,965 | 1/1951 | Moss et al. | 101/247 |
| 3,254,598 | 6/1966 | Motter | 101/247 |
| 3,635,160 | 1/1972 | Specht et al. | 101/247 |
| 4,413,541 | 11/1983 | Biggar, III | 101/247 X |
| 4,413,560 | 11/1983 | Rogge | 101/247 |
| 4,527,474 | 7/1985 | Lübke et al. | 101/247 |
| 4,602,562 | 7/1986 | Ottenhues et al. | 101/182 |
| 4,852,515 | 8/1989 | Terasaka et al. | 101/351 X |

*Primary Examiner*—Edgar S. Burr
*Assistant Examiner*—Christopher A. Bennett
*Attorney, Agent, or Firm*—Fleit, Jacobson, Cohn, Price, Holman & Stern

[57] ABSTRACT

This invention relates to an apparatus for displacing shaft-mounting bearing stands, which are secured to carriages, in carriage guides, preferably for displacing the bearing stands of plate cylinders and inking rollers of a printing unit in carriage tracks of the inking unit supports of a multicolor rotary press, comprising screw drives, which are driven by electric motors. To solve the object to provide such an apparatus in which shafts and particularly plate cylinders and associated inking rollers can mutually independently be displaced relative to each other and, e.g., relative to an impression cylinder, the invention resides in that a screw that extends parallel to a single carriage track is rotatably mounted in the machine frame or on the inking unit support and is provided with a drive. A nut which is non-rotatably and axially immovably connected to a bearing stand or to a carriage is mounted on the screw. At least one additional nut is mounted on the screw and is rotatably and axially immovably connected to at least one additional bearing stand or to the associated carriage and is connected to a separate drive.

6 Claims, 4 Drawing Sheets

APPARATUS FOR DISPLACING SHAFT-MOUNTING BEARING STANDS

BACKGROUND OF THE INVENTION

1. Field of the Invention

The invention relates to an apparatus for displacing shaft-mounting bearing stands, which are secured to carriages, in carriage guides, preferably for displacing the bearing stands of plate cylinders and inking rollers of a printing unit is carriage tracks of the inking unit supports of a multicolor rotary press, comprising screw drives, which are driven by electric motors, preferably by stepping motors.

2. Description of the Prior Art

Such as apparatus for displacing the bearing stands for a plate cylinder and an inking roller of a flexographic press is known, e.g., from German Patent Specification 29 41 521. In that known apparatus the bearing stands for the plate cylinder are guided in carriage tracks of the inking unit supports and are provided with separate screw drives, the carriages for the plate cylinders are provided with further carriage tracks for the carriages which carry the bearing stands for the inking rollers, and the latter carriages are provided with separate screw drivers. Whereas that known apparatus is inherently satisfactory in operation, it is rather expensive owing to the provision of the additional carriages, which are guided in carriage tracks and are provided with additional carriage tracks for carriages that are displaceable thereon.

French Patent Specification 669,672 discloses a printing press which comprises a plurality of printing units and in which each plate cylinder and each inking unit associated therewith are slidably mounted by guide bushings on a common track tube and are displaceable by means of a single screw, which is provided with a drive. Each inking unit consists of an endless inking belt, which is associated with the plate cylinder and revolves around guide rollers. To permit a disengagement of the plate cylinder from the impression cylinder and a disengagement of the inking belt from the plate cylinder, the threads of the screw have different leads and that screw section which serves to move the inking unit has a larger lead than the screw section which cooperates with the plate cylinder, As a result, a rotation of the screw will impart to the inking unit a larger displacement than to the bearings for the plate cylinder. But that known apparatus has the disadvantage that the plate cylinder and the inking unit cannot be moved independently of each other but both perform predetermined movements relative to each other as the screw is driven. For this reason it is not possible in the known apparatus to force the plate cylinder more strongly against the impression cylinder without a change of the contact pressure of the inking belt. It is also not possible to force the inking belt more strongly against the plate cylinder and at the same time to force the plate cylinder less strongly against the impression cylinder. Owing to the fixed coordination of the relative movements of the bearing stands for the plate cylinder and of the inking unit it is also not possible in the known apparatus to perform a so-called clean-up printing in that the inking belt is disengaged from the inking roller when the print operation has been proper completed so that the inking roller and the plate cylinder contacting the impression cylinder can then perform some additional revolutions, the remaining ink is thus removed from the inking roller and the plate cylinder and is applied to the material to printed, which passes through.

SUMMARY OF THE INVENTION

It is an object of the invention to provide an apparatus which is of the kind described first hereinbefore and in which shafts and particularly plate cylinders and associated inking rollers can mutually independently be displaced relative to each other end, e.g., relative to an impression cylinder.

In an apparatus which is of the kind described first hereinbefore that object is accomplished in accordance with the invention in that a screw that extends parallel to a single carriage track is rotatably mounted in the machine frame or on the inking unit support is provided with a drive, a nut which is nonrotatably and axially immovably connected to a bearing stand or to a carriage is mounted on the screw, and at least one additional nut is mounted on the screw and is rotatably and axially immovably connected to at least one additional bearing stand or to the associated carriage and is connected to a separate rotary drive. The apparatus in accordance with the invention has a relatively simple design because only a single screw is provided for displacing a plurality of shafts or cylinders. To permit the use of that single screw for effecting a plurality of displacements independently of each other, one nut on the screw is fixedly connected to one carriage or bearing stand, and at least one additional nut on the screw is rotatable relative to the bearing stand which is to be displaced, so that the latter nut can be rotated by a separate drive to effect a displacement which is independent of the displacement of the first bearing stand. But because all nuts are mounted on one and the same screw, which has a uniform lead, the nuts must be rotated by the associated drives to perform additional revolutions, by which the rotation of the screw is compensated when no displacement or a predetermined displacement is desired in spite of the rotation of the screw. Revolutions by which superimposed revolutions of the screw are compensated can easily be imparted to those nuts which are rotatably mounted in carriages if the nuts are driven by controllable motors, such as stepping motors, and microprocessor control means.

If the apparatus is intended to effect only the displacements of one plate cylinder and one inking roller relative to each other and to an impression cylinder, it will be sufficient to mount on the screw only two nuts, which are associated with two bearing stands.

In accordance with a further proposal how the object can be accomplished, different displacements may be effect in a single manner if one screw extending parallel to a single carriage track is non-rotatably and axially immovably held in the machine frame or on the inking unit support, at least two nuts are mounted on the screw and each of said nuts is rotatably and axially immovably connected to a bearing stand or to a carriage carrying that stand and is connected to a separate rotary drive. In that embodiment the screw is rigidly held so that the drives for the nuts will not be required to take revolutions of the screw into account or to compensate such revolutions. Again, more than two nuts may be mounted on the screw but only two nuts on the screw will be required it is desired to control the displacements of one plate cylinder and one inking roller relative to each other and to an impression cylinder.

Those nuts which are rotatable relative to the bearing stands are suitably held in bushings, which are rotatably mounted in the bearing stands. The bushings may be provided with sleeves, which extend the bushings in length and to which the drive gears are secured. Said drive gears may be driven via belt drives from the output gears of the electric motors or stepping motors or of reducing gear trains driven by such motors.

Separate drive screws are suitably associated with the bearing stands provided at opposite ends of the shafts or of the plate cylinders and inking rollers so that the drive screws can be so controlled that the shaft and/or cylinder or roller can be adjusted to oblique orientations or such orientations can be compensated.

DETAILED DESCRIPTION OF THE PREFERRED EMBODIMENTS

Figure 1:
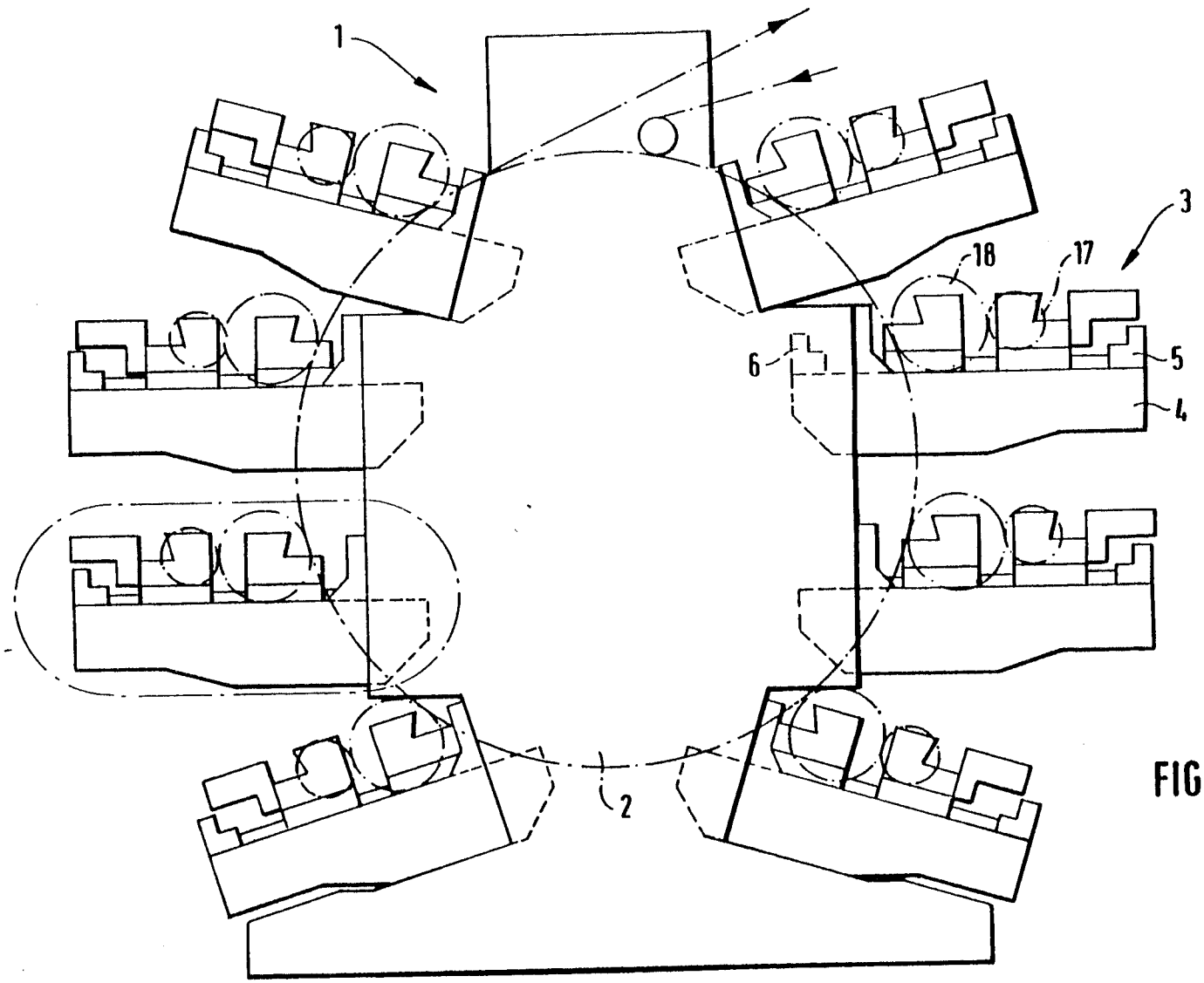
FIG. 1 is a diagrammatic side elevation showing a flexographic press comprising eight printing units.

Illustrative embodiments of the invention will now be described more in detail with reference to the drawing.

Figure 2:
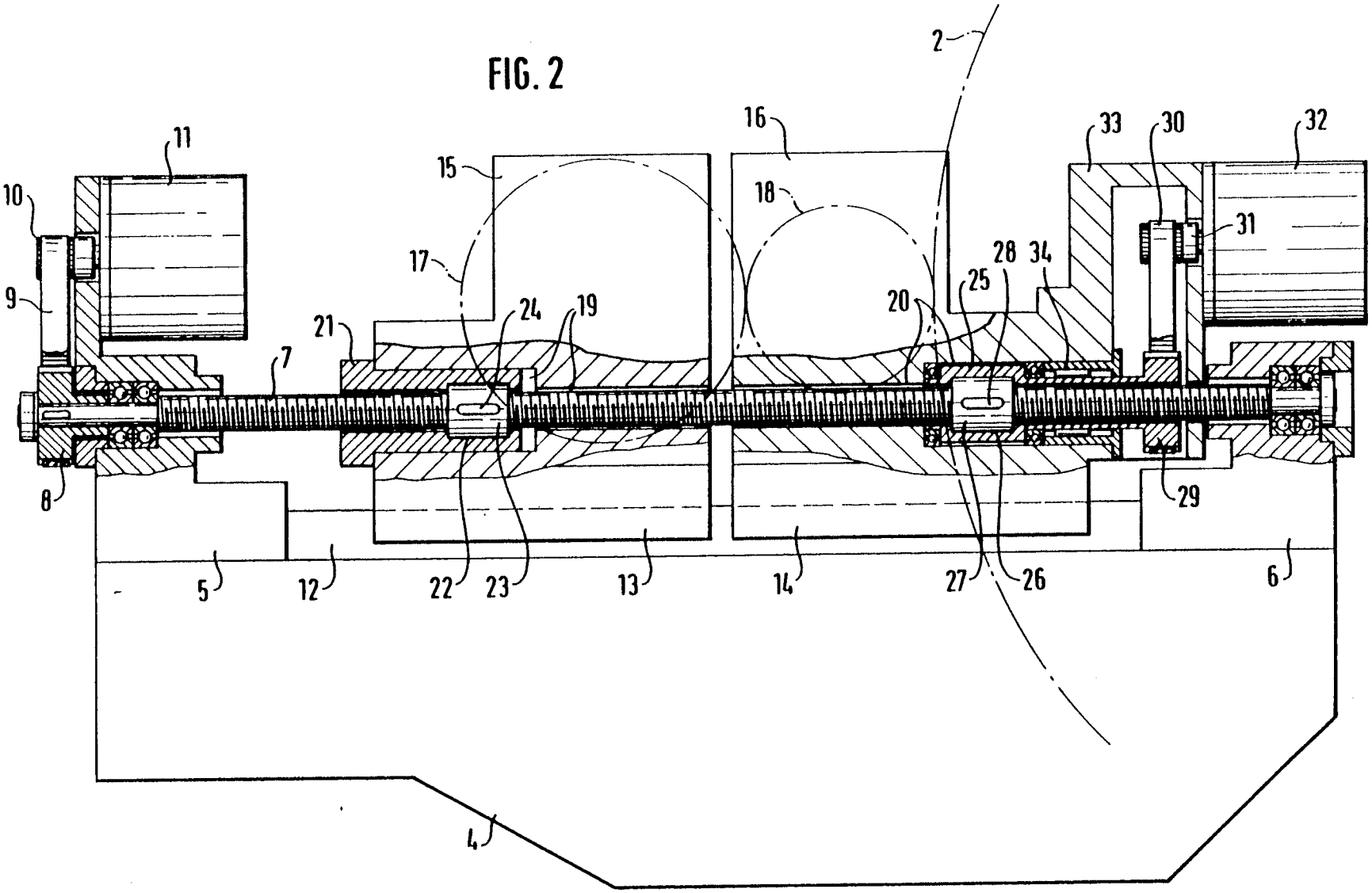
FIG. 2 shows on a larger scale, partly in section, that printing unit which is surrounded by broken lines in FIG. 1.

The flexographic press 1 shown in FIG. 1 comprises a central impression cylinder 2, which can cooperate with eight printing units 3. Each of said printing units 3 comprises an inking unit support 4, to which two bearing stands 5 and 6 are fixedly connected, e.g., by screws. A screw 7 is rotatably mounted in the bearing stands 5 and 6 (FIG. 2). That screw 7 can be rotated by means of a gear 8, which is splined to the screw 7 at its left-hand end and is connected by a cogged belt 9 to a pinion 10 of a stepping motor 11. The latter is also connected to the bearing stand 5. A linear track 12, which is fixed to the inking unit support, extends between the two bearing stands 5 and 6 and supports two carriages 13 and 14. Bearing housings 15 and 16 are fixedly connected to the carriages 13 and 14. A screen roller 17 is rotatably mounted in the bearing housing 15. A corresponding plate cylinder 18 is rotatably mounted in the bearing housing 16. The roller 17 and the cylinder 18 are adapted to be driven by means which are not shown. The housings 15 and 16 are formed with respective stepped bores 19 and 20, which are aligned with each other. The screw 7 extends through the two bores 19 and 20. As is apparent from FIG. 2, a bushing 21 is fixedly inserted in that portion of the bore 19 which is larger in diameter and that bushing 21 has a hollow-cylindrical counterbore 22, in which a nut 23 is mounted. By means of a feather key 24 the nut 23 is nonrotatably held in the bushing 21. As a result, the motor 11 is operable to move the bearing housing 15 in one direction or the other, depending on the sense of rotation of the motor 11, whereas the nut 23 is held in position.

In the right-hand bearing housing 16 a bushing 25 is also inserted in that portion of the bore 20 which is larger in diameter but the bushing 25 is rotatable relative to the bearing housing 16. The bushing 25 is also formed with a counterbore 26, in which a nut 27 is mounted, which is non-rotatably connected to the bushing 25 by a feather key 28. A gear 29 is non-rotatably connected to the bushing 25 and by a cogged belt 30 is operatively connected to the pinion 31 of the motor 32. The motor 32 is fixed by screws to the gear housing 33, which is fixed to the bearing housing 16. As a result, an operation of the stepping motor 32 will rotate the nut 27 so that the entire unit (16 and 33) can be moved to and from on the screw 7 together with the nut 27.

When the printing operation proper has been completed and the screen roller 17 is to be disengaged, the motor 11 is started to rotate the screw 7. As the nut 23 is non-rotatably held in the bushing 21 and the latter is fixed to the bearing housing 15, the latter departs from the plate cylinder 15. For clean-up printing, the plate cylinder 18 must now remain in the position shown in FIG. 2 and to that end the motor 32 is started too to rotate the bushing 25 in the opposite sense so that the bearing housing 16 is held in engagement with the impression cylinder 2. When the plate cylinder 18 has been cleaned up by printing on the impression cylinder 2 and/or on the web moved between the cylinders 18 and 2, the motor 32 can be stopped so that a continued operation of the motor 11 will move not only the bearing housing 15 but also the bearing housing 16 together with the plate cylinder away from the central impression cylinder. It is apparent that the cylinders and rollers can be moved to desired positions relative to each other by a suitable operation of the motors 11 and 52. The bushing 25 is held in the bearing stand 16 by the cap 34.

In the embodiment shown in FIG. 1 the two bearing housings 15, 16 can be adjusted in unison without performing a movement relative to each other by an operation only of the motor 11 although it is desirable in that case to brake the motor 32.

Figure 4:
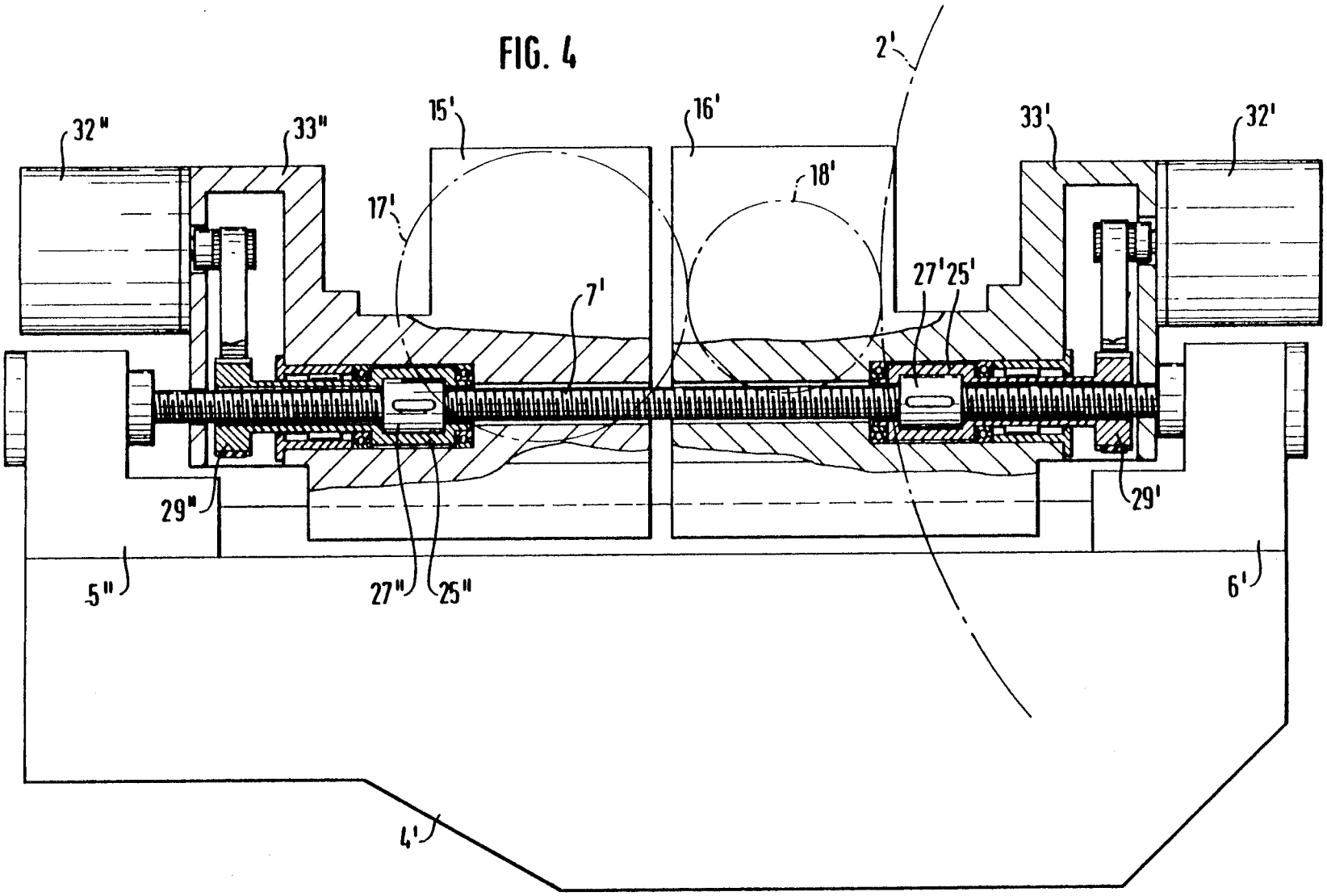
FIG. 4 shows a modified embodiment of the printing unit of FIG. 2.

The embodiment shown in FIG. 4 differs from that of FIG. 2 in that the screw 7' is held against rotation in the bearing stands 5' and 6'. Just as in the embodiment shown in FIG. 2 the general arrangement as far as the bearing housing 16' is concerned is identical to the arrangement of the bearing housing 16. On the other hand, the bearing housing 15' does not correspond to the bearing housing 15 shown in FIG. 2 but is a mirror image of the bearing housing 16'. When the printing operation proper has been completed and it is desired first to disengage the screen roller 17 from the plate cylinder 18', the motor 32'' is started to that the gear 29'' rotates the sleeve 25'' and together with that sleeve the nut 27''. As a result, the entire unit consisting of the bearing housing 15' and gear housing 33' is moved away from the plate cylinder 18'. Regardless of whether or not the operation of the motor 32'' is continued, the motor 32' may be started after a certain time so that the gear 29' in mesh with the cogged belt, the bushing 25' and the nut 27' are operated to move the bearing housing and also the plate cylinder 18' away from the central impression cylinder 2. It is apparent that in the embodiment shown in FIG. 4 the motors 32' and 32'' may also be operated with such a timing that the bearing housings 17' and 16' are moved independently of each other.

Figure 3:
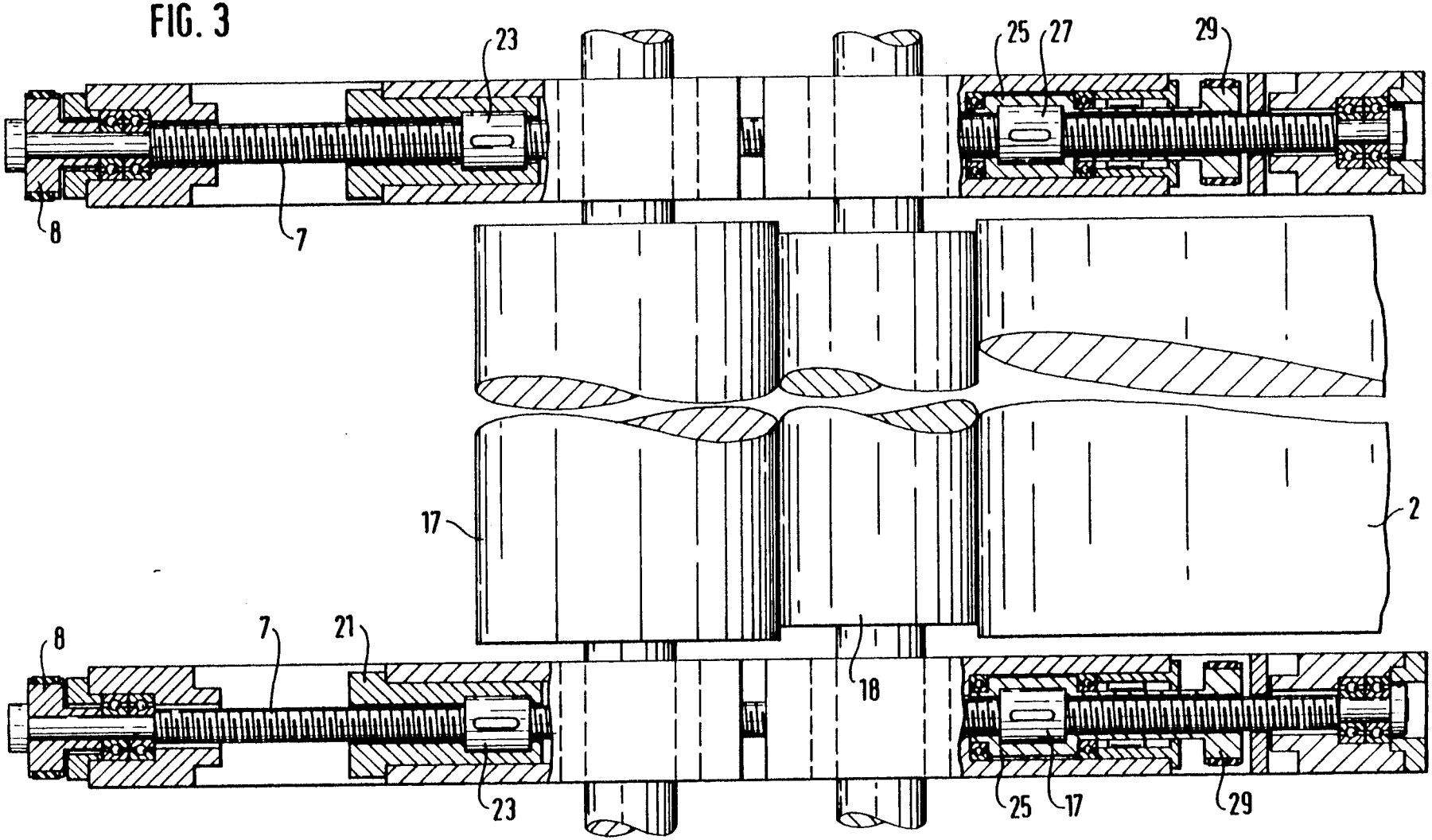
FIG. 3 is a top plan view showing the printing unit of FIG. 1, partly in section.

Upon an inspection of FIG. 3 it will become apparent that the plate cylinder and the screen roller can be adjusted so that their axes are no longer parallel. Besides, the plate cylinder and screen roller may be left in an orientation in which their axes are parallel and may be adjusted in unison to a position in which they are oblique to the central impression cylinder 2. Such oblique positions will usually be adopted for a compensation of deviations when the impression cylinder is not perfectly cylindrical and of thickness variations of printing blocks or plates.

I claim:

1. An apparatus for displacing a pair of shaft mounting bearing housings secured to carriages, along a carriage track, in particular for displacing plate cylinder and inking roller bearing housings of a printing along a carriage track of an inking unit support of a multicolor rotary printing press, comprising:

a screw extending parallel to the carriage track, said screw being rotatably mounted on bearing stands at opposite ends of the track, an electric motor connected to a drive for rotating said screw, a first nut non-rotatably and axially immovably connected to one of said bearing housings, said first nut being mounted on said screw, an additional nut mounted on said screw, said additional nut being rotatably and axially immovably connected to the other one of said bearing housings, and a separate rotary drive motor connected to an additional drive for rotating said additional nut.

2. Apparatus according to claim 1, wherein the additional nut is non-rotatably mounted in a bushing rotatably mounted in said other one of said bearing housings.

3. Apparatus according to claim 2, wherein said additional drive includes a drive gear formed on a sleeve extended from said bushing.

4. An apparatus for displacing a pair of shaft mounting bearing housings secured to carriages along a carriage track, in particular for displacing plate cylinder and inking roller bearing housings of a printing unit along a carriage track of an inking unit support of a multicolor rotary printing press, comprising:

a screw extending parallel to the carriage track, said screw being non-rotatably and axially immovably mounted in bearing stands at opposite ends of the track, two nuts mounted on said screw, respective ones of said nuts being rotatably and axially immovably connected to respective ones of said bearing housings, and a separate rotary drive motor being connected to each one of said two nuts by respective drives for separately rotating the respective nuts.

5. Apparatus according to claim 4, wherein the respective nuts are non-rotatably mounted in respective bushings which are rotatably mounted in the respective bearing housings.

6. Apparatus according to claim 5, wherein the respective drives include respective drive gears formed on respective sleeves extended from the respective bushings.

* * * * *